United States Patent [19]

Valditerra

[11] 4,325,306

[45] Apr. 20, 1982

[54] MACHINE FOR THE RENEWAL OF RAILWAY TRACKS

[75] Inventor: Sergio Valditerra, Novi Lugure, Italy

[73] Assignee: Canron Inc. (Montreal), Vaud, Switzerland

[21] Appl. No.: 20,274

[22] Filed: Mar. 14, 1979

[30] Foreign Application Priority Data

Mar. 15, 1978 [IT] Italy ..... 67562 A/78
Apr. 21, 1978 [IT] Italy ..... 67906 A/78

[51] Int. Cl.[3] ..... E01B 29/05
[52] U.S. Cl. ..... 104/2
[58] Field of Search ..... 104/2, 7, 8, 5; 171/16

[56] References Cited

U.S. PATENT DOCUMENTS 2,921,537 1/1960 Christoff ..... 104/2
4,046,077 9/1977 Thevrer et al. ..... 104/2
4,178,995 12/1979 Thevrer et al. ..... 104/2
4,184,431 1/1980 Goel ..... 104/2
4,207,820 6/1980 Sain ..... 104/2

*Primary Examiner*—Richard A. Bertsch
*Attorney, Agent, or Firm*—Anthony J. Casella

[57] ABSTRACT

A machine for the renewal of railway tracks adapted to replace old rails and/or old sleepers with new rails and/or new sleepers.

This machine comprises two frames connected by a swivel and resting on a front, middle and rear bogie. The equipment for the removal of old rails is disposed between the front and middle bogie, and the equipment for the removal of old sleepers, the renewal of the ballast, the laying down of new sleepers and new rails, is located between the middle bogie and the rear bogie. The middle bogie is equipped during the working cycles with a carriage means capable of progressing on the old sleepers still in service but deprived of rails, which sleepers act as a lateral guiding means for said carriage means.

12 Claims, 8 Drawing Figures

MACHINE FOR THE RENEWAL OF RAILWAY TRACKS

The present invention is concerned with a machine for the renewal of railway tracks of the type which normally replaces old rails and/or old sleepers of a railway track by new rails and/or new sleepers.

Among the machines for the renewal of railway tracks known up to now, the most prevalent which is also the most efficient includes two trucks or carriages, both supported by two bogies, the first truck running on the tracks to renew and the second on the tracks already renewed, and a main girder laid between the two trucks, and articulated at both ends by swivels rigidly connected with the trucks. This girder carries the machinery for removing and carrying away the old rails and old sleepers, for the renewal of the ballast, for carrying and laying down the new sleepers in the correct position and, finally, for laying down the new rails on the new sleepers. The first truck is equipped with conveyors working jointly with a gantry crane in order to carry away and to lay down on the supply-train the withdrawn sleepers and pick up the new sleepers on the supply train in order to lay them down. The second truck carries an electric power plant in order to supply energy to the auxiliaries and to ensure the autonomy of the traction of the train by means of hydraulic motors incorporated in the four bogies and running during the working cycles.

This solution leads to a machine for the renewal of railway tracks of a substantial length. Indeed, the length of the main beam must equal the total length of all the successive working machineries, to which the length of both trucks carrying the beam must be added. A train of such overall length is accordingly very heavy and expensive. Furthermore, it will not function properly on short radius curves. Finally, it is practically impossible to replace especially heavy rails due to the limitation of the authorized overall length of the girder and general overall dimension specifications.

The main object of the present invention is a machine for the renewal of railway tracks of the type described above, presenting an overall length substantially reduced, which weight and cost are reduced accordingly and which can be employed on short radius curves and is able to replace especially heavy rails.

Another purpose of the present invention is a similar machine which can be adapted in order to lay down sleepers and rails on a new track.

The suppression of the main girder articulated between both trucks represents the fundamental idea of the present invention, which claims a machine for the renewal of railway tracks basically made of two frames connected and articulated by a swivel, resting both, with their opposite ends, on front, middle and rear bogies and equipped with the machinery for removing the old rails, disposed between the front and middle bogies, and the machinery for removing the old sleepers, for renewal of the ballast, for laying down the new rails and new sleepers, disposed between the middle and rear bogies, said middle bogie being equipped, during the working cycle, with carriage means ensuring the progression of said middle bogie on the old sleepers still on the track but deprived of rails, said sleepers acting as appropriate lateral guides.

Another idea, of utmost importance, is to equip both frames with dynamic means in order to transfer on both end bogies a part, which can be important, of the load bearing on the middle bogie, said means being preferably controlled by manual or automatic control systems in order to maintain sensibly constant the load bearing on the middle boggie, during normal working cycles, and to alter said load property whenever required.

Furthermore, when such a machine is employed to replace old sleepers by new sleepers (or for the laying down of new sleepers on new tracks), it is imperative that the new sleepers are layed down in the exact desired transversal position, in order to avoid any change of direction of the line, unless one does it willingly. The machine according to the invention is able, due to its geometry, to lay down new sleepers in the exact position on straight sections and in an approximative position on curved sections, unless one requires a correction system in order to secure a maximum of precision in the curves.

According to the present invention, this aim is fulfilled in that the frame which carries the working machineries, especially the machinery for laying down new sleepers, is fitted in order to be moved laterally and is equipped with a system for controlling said lateral movement of said frame whose working is itself controlled by the relative displacement of both frames composing the machine around their common swivel, in order to lay down the new sleepers in a correct position and with an appropriate precision.

The system controlling the lateral movement of the frame will include, preferably, a beam swivelling on a console of the rear frame and whose upper end is articulated with a projection of the front frame and whose lower end is articulated with the frame carrying the working machineries. If the parts are correctly dimensioned and if both arms of the swivelling beam present the same length, said beam will produce, with respect to the swivelling point of the rear frame, a lateral movement of the frame equal and of opposite direction to and from the movement accomplished by the projection of the front frame, because of the track's curvature.

The present patent specification which follows describes, by way of an example and not limitatively, a form of the machine for renewal of railway tracks according to the present invention, which will be understood with the enclosed schematic drawing, where FIG. 1 represents a small scale side view, as schematic as possible, of the front frame of the machine, FIG. 2 represents a similar side view of the rear frame of the machine, FIG. 3 represents a larger scale side view of the central part of the machine, showing the rear end of the front frame with its middle bogie, the front end of the rear truck with the swiveling system and the dynamic means acting on both frames.

Figure 1:
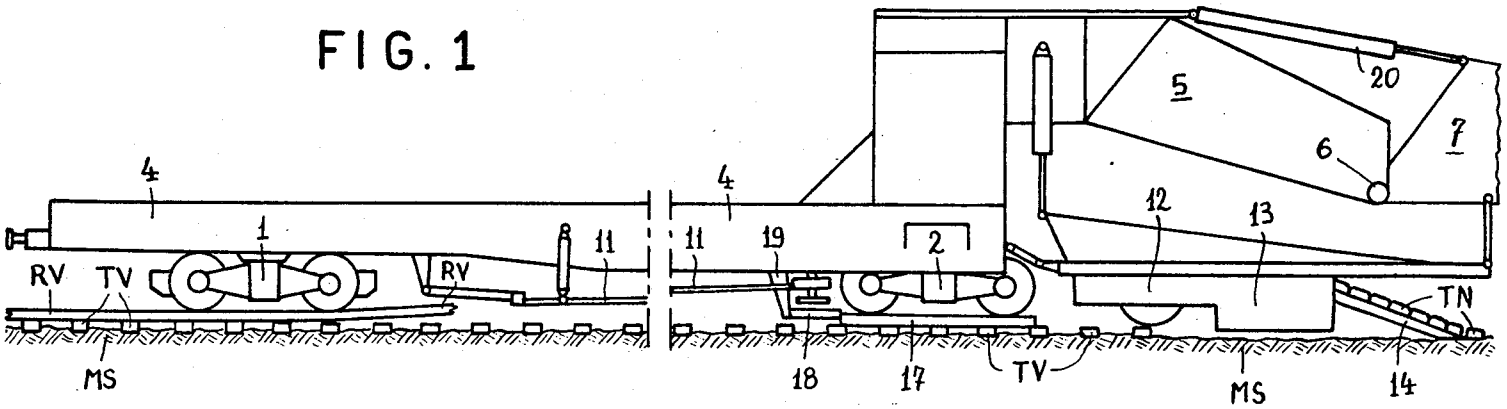

The machine according to the present invention is made of a front frame 4 resting on both front and middle bogies 1 and 2, respectively and of a rear frame 7 resting on rear bogie 3, connected, on the opposite end, by means of a swivel 6, to a console 5 rigidly connected with the front frame 4. The end bogies 1 and 3 are equipped with hydraulic motors making the machine self-propelled during the working cycles. Power is provided by an electric power plant 8, mounted on the frame 7, above the bogie 3, which drives an hydraulic power plant 9 which supplies the necessary hydraulic pressure. A driver's cabin 10 is provided for the conductors of the machine.

Figure 2:
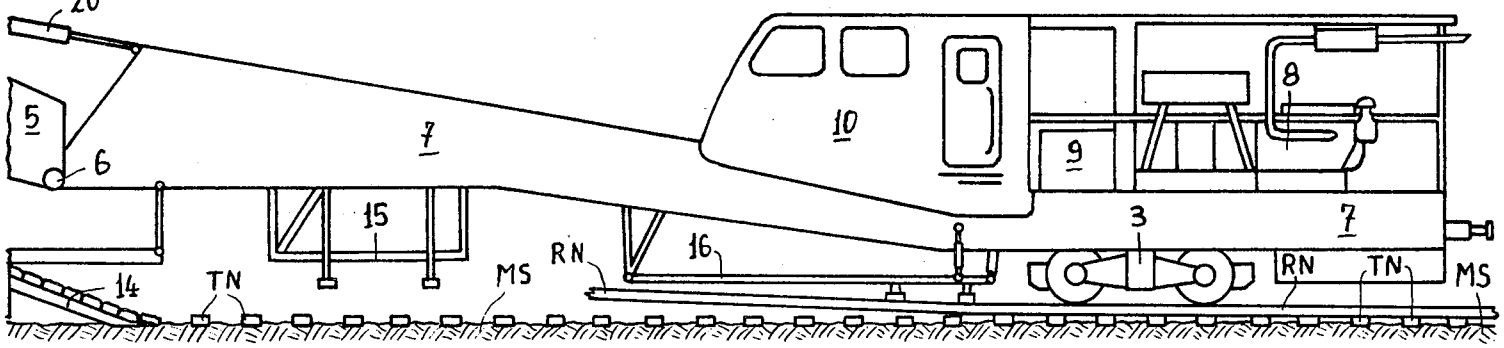
Figure 3:
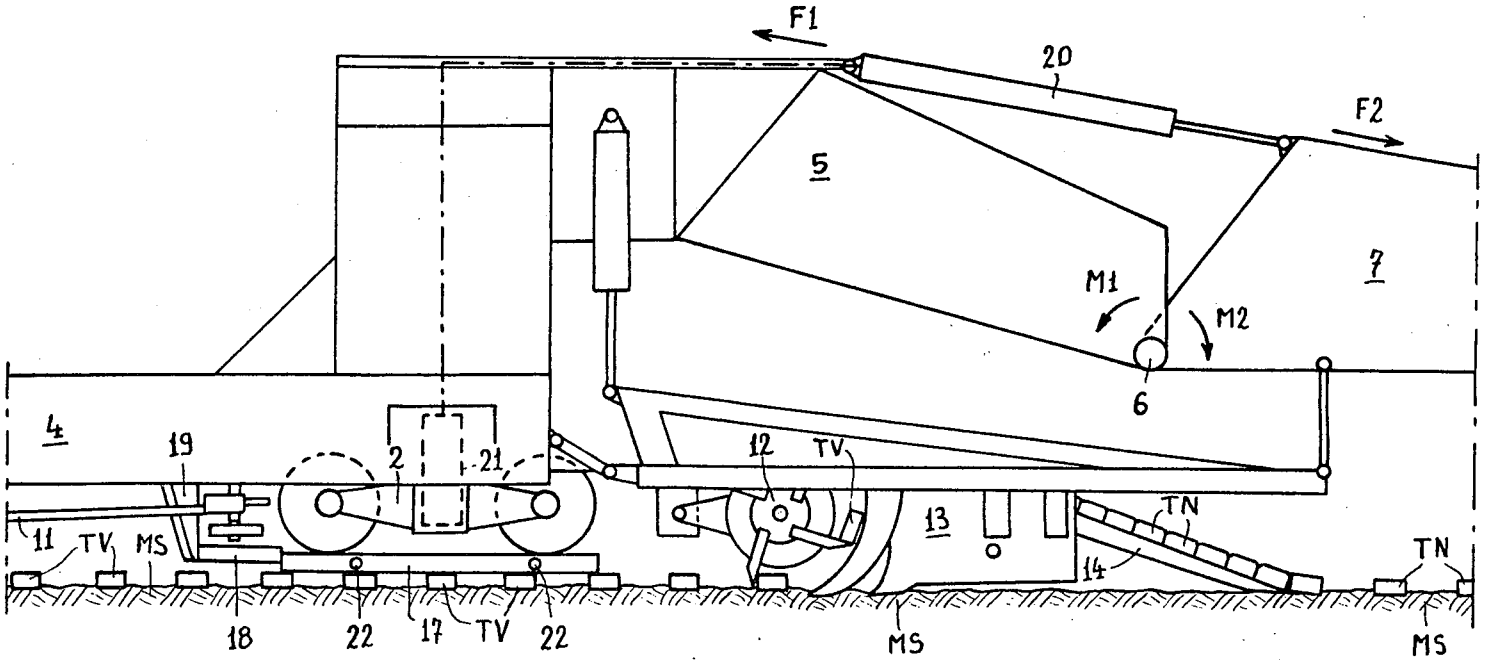

The front truck 4 carries the appropriate machinery 11 for removing and withdrawing old rails RV (a portion only of the track has been represented at the left of FIG. 1 in order to simplify the drawing). Said machinery 11 is mounted between the front bogie 1 and the middle bogie 2, said front bogie running normally on the old rails still in service and said middle bogie being in an area deprived of rails. The space between the middle bogie 2 and the rear bogie 3 is occupied partly by the console 5 of the front frame and, for the rest of it, by the rear frame. In this space, one employs, successively, a machinery 12 for removing and withdrawing old sleepers TV, better detailed by FIG. 3, a machinery 13 for the renewal of the ballast MS, a machinery 14 for laying down new sleepers TN and the machineries 15 and 16 for laying down, at the correct gauge, new rails RN on which runs the rear bogie 3 of the machine. In order to simplify the drawing, only a portion of the new track has been represented at the right of FIG. 2.

The construction and the working of the different machineries described hereabove are well known and are not part of the present invention. For this reason, they are represented schematically only and they will be neither specified nor represented in details.

The fundamental idea of the present invention can be explained as follows. Whereas machines or trains for the renewal of railways tracks, already mentioned, are usually of the type having two bogies, both running on the old track still in service, and two other bogies, both running on the new track already renewed, the integrality of the renewal equipment being inserted between the two intermediate bogies, resulting in a machine of substantial length, on the contrary, in the machine according to the present invention, the renewal equipment is inserted between the first and the last of the three bogies equipping the machine, said front bogie only running on the old track still in service and said rear bogie only running on the track already renewed, whereas the middle bogie is to be found in an area of the track still equipped with old sleepers, but deprived of rails. In order to ensure the progression of said middle bogie, one has forseen carriage means 17 connected, during the working cycles, to the frame 4 by driving means 18 and 19. The bogie 2 is resting on said carriage means 17, which is designed in order to progress on the old sleepers TV in such a way as a sledge which, itself, must be guided laterally by adequate means. In fact, the shoulders of the rail-chairs which fasten and guide the old rails RV or, in the case of wooden sleepers deprived of chairs, the mortises machined in said slippers, with a prescribed transversal banking, in which the rails are sometimes directly fastened, represent said lateral guiding means.

Different forms of execution can be proposed for the carriage means 17. One can imagine, by example, a frame carrying the bogie 2 equipped with a plurality of rollers capable of rolling on the sleepers TV, or also a sledge whose runners are calculated to slide on the sleepers or on their rail-chairs. Whichever solution is adopted, the carriage means 17 must progress in the space previously occupied by the rails. Therefore, the width and the gauge of said means must correspond with the width and gauge of a railway track in order to be guided as the rails are guided by the mortises of the sleepers or by the rail-chairs. One can imagine another guiding means made of the sleepers themselves and placed on another part of the sleepers or by any normal or special fastening or clipping device, provided that the carriage means 17 is really guided.

In the preferred example of execution of the present invention, the carriage means 17 is a sledge realized by cutting a portion of the old track RV, in front and in the rear of the middle bogie 2, the connection between both rails of the portion being made of cross-bars 22. One sees the left ends of these cross-bars at the FIG. 3. This method gives a sledge not only capable of sliding, but also properly guided on the old sleepers TV. This sledge presents many important advantages. Briefly, at the beginning of a working cycle, one realizes the carriage means 17 by merely cutting the portion of the track on which the bogie 2 is resting or by cutting any appropriate portion which will carry the bogie 2. Latter solution avoids the fastidious transportation of a portion of track used as carriage means 17 in order to carry boggie 2. Successively and at the end of each shift in charge of the renewal of the tracks, the portion of track 17 employed as carriage means for bogie 2 will be placed against the cutted ends of the old track and connected to the latter, whereas the new track will be cut and connected behind the portion of track 17. This solution allows the laying out in line of the tracks during the progressions. The track is also ready for the running of bogie 2 for the next shift in charge of the renewal. One can also realise this way substantial savings in time and manpower at the beginning and end of each renewal cycle.

Similar results may nevertheless be obtained with carriage means 17 made of a sledge of appropriate design, which can be held on the tracks between renewal cycles.

When not working, the machine is dragged normally on its three bogies for the displacements. On the other hand, during the working cycle, the machine progresses with the help of the autonomous traction being insured by both end bogies and rests with its central bogie (the wheels of said bogie are not running and may be blocked if necessary) on the carriage means 17, which slides on the old sleepers TV and is guided by the latter, in order to preserve the alignment of the renewal machinery. This disposition also secures that the laying down of the new sleepers and rails is made according to the position of the old sleepers and rails (a slight correction is however possible, if necessary) and that the machine follows exactly the prescribed line.

According to the present invention, a reduction of the overall length of the machine results in an increase of the effective length regarding the deflection of the rails. Consequently, one may lay down heavier rails of higher rigidity.

Of course, one will use only a part of the machinery for the renewal of either the sleepers or the rails. In the case of the renewal of just the sleepers, the old rails will not be removed, but solely put aside by the machinery 11 and relaid by machinery 16 after replacement of the sleepers. Inversely, in the case of renewal of just the rails, the machineries 12 to 14 will be stopped. Both cases do not modify the application of the invention.

The laying down of a new track on a new and unused ballast, i.e. without previous tracks, represents a particular case of application of the machine according to the present invention. Any known machine for the renewal of railway tracks cannot run on such a ballast. In said application, the machine described in the present specification will progress in the opposite direction of the normal direction (progression from left to right on the drawing), provided that bogie 3 be equipped with some kind of tires allowing it to progress on the ballast and with appropriate guiding means.

The laying down of new sleepers will be accomplished by machinery 12, whose working will be reversed and which will be modified accordingly, in order to accomplish said function. The middle bogie 2, equipped with the carriage means 17, will thereafter progress on the layed down sleepers and be guided consequently. By reversing the working of machinery 11, also modified accordingly, one will lay down the rails. Bogie 1 and supply-trains may now run on the new track. Thus is increased the field of application of the machine according to the present invention.

The front frame 4 of the machine according to the present invention is equipped with conveyors, of a well known type, for the supply and withdrawal of material. From time to time, a gantry crane, according to well known methods, is working in connection with the conveyors and the carriages of the supply-train, in order to supply and evacuate rails and sleepers. For this reason and because of the backward and forward motion of the gantry crane, the load acting on the middle bogie 2, which is already rather important because of the weight of the structure itself, machineries and materials, will tend to vary. This condition does not act in favor of the translation of the means 17 on the sleepers. In most cases, it would be wise to reduce or at least to keep constant the load acting on the middle bogie 2.

According to an important feature of the present invention, this can be accomplished by applying an appropriate force on the front frame 4, 5 and on the second frame 7, taking the form of a moment acting around the axis of the swiveling point 6. As a result of this moment, a composing part of the load applied normally on bogie 2 is transferred and distributed between bogies 1 and 3.

A hydraulic ram 20 inserted, by example, between the console 5 of the first frame 4 and the rear frame above the swivel 6 may furnish the appropriate moment for reaching that object. Said ram 20 is fed in order to apply on the parts to which it is connected the forces $F_1$ and $F_2$ which form the moments $M_1$ and $M_2$ with the help of the reaction of the swiveling point 6. These moments tend to lift the central part of the machine in the same manner as an arch sustained by its posts. By controlling properly the feeding pressure of the ram 20, it will be possible to apply a load on bogie 2 of a value favorable for the translation of the means 17. The value of the load can be of the order of 8 to 10 tons, by example. Preferably, one will incorporate in the suspension of the bogie 2 a dynamometric control system, schematically shown at the FIG. 3, in order to control the feeding pressure of the ram 20 and, accordingly, to fix automatically and permanently the load applied on bogie 2 at the desired value. This value should not be affected by the circulation of the gantry crane nor by any other outside action intended or not which may affect said load.

The hydraulic ram 20 is a very convenient means for reaching said object. It can, of course, be replaced by mechanical or electromechanical means or, generally speaking, by any kind of machinery capable of applying and controlling, preferably, a force of desired value.

One may notice a useful consequence of the application of both forces $F_1$ and $F_2$ on both end bogies of the machine when employed for the renewal of railway tracks in the curves. In that case, said bogies are meeting at a certain angle and both forces $F_1$ and $F_2$ do not apply anymore in the longitudinal plane of the machine. However, they create moments, which tend to tilt backwards the machine outside the curve. These moments reduce favorably the overload applied on the internal rail line of the curve. Said overload is due to the transversal banking of the track. The banking which is foreseen for the normal speed of trains hampers machines for the renewal of railway tracks because of their low speed.

The hydraulic ram 20, or any other means applying a force on both end bogies of the machine, will be oriented, preferably, in the direction of the bolster of the rear bogie 3 in order to prevent overstressing frame 7.

As it can be understood from the present specification, the application of the invention is a machine for the renewal of railway tracks substantially shorter, lighter and less expensive, and finally of a greater flexibility, than known executions.

Figure 4:
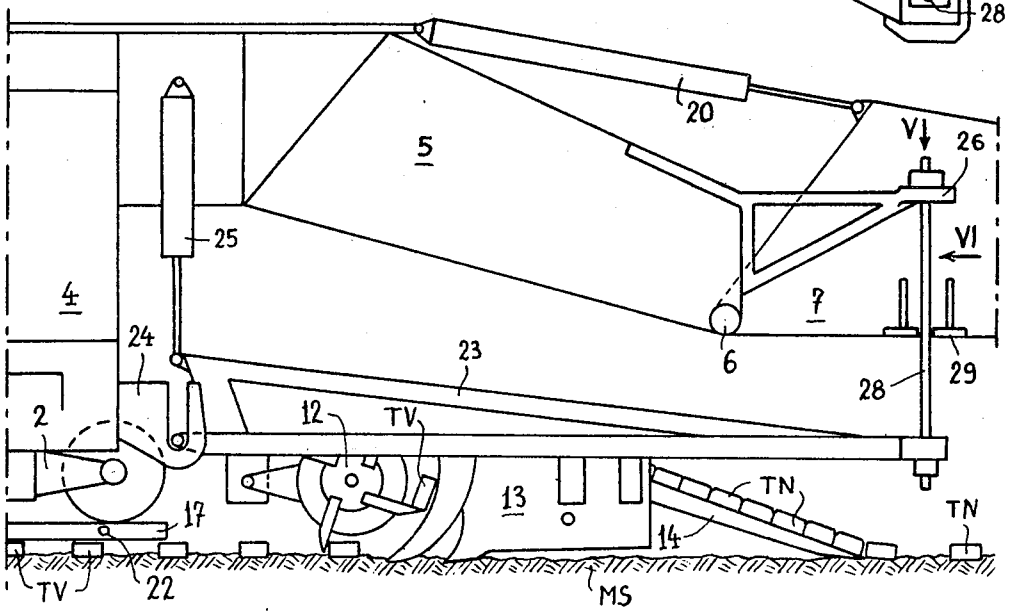
FIG. 4 represents a side view of the central part of a machine for the renewal of railway tracks according to the present invention, showing the frame carrying the working machineries and the proper control system.

FIG. 4 represents the rear port of the front frame 4 resting on the middle bogie 2, which rests itself on the carriage means 17. The latter is carried and guided by the old sleepers TV still layed on the ballast MS. This front frame includes a console 5, on which is articulated at the swivelling point 6 the front end of the rear frame 7. The frame 23 carries the central working machineries, i.e. the machinery 12 for removing and withdrawing the old sleepers TV, the machinery 13 for the renewal of the ballast and finally, the machinery 14 for laying down new sleepers TN in which the invention is mainly concerned. The front end of frame 23 is hooked on the frame 4 by one or several hooks 24 fitted so as to secure the lifting of frame 23 with the help of a hydraulic ram 25, for example, when said frame is not in use during the runs of the machine.

In order to carry the rear end of frame 23 and to control the lateral movements, the console 5 fitted at the rear end of the front frame 4 comprises two arms 26 and 27 on which is hanging up said rear end of said frame 23. The suspension for hanging up said part is realized on one hand by a mere tie-rod 28 which upper end is articulated with the arm 26 and the lower end is articulated with the frame 23 and which center part, if necessary, is guided by a fork 29 rigidly connected with the front end of the rear frame 7. Said tie-rod may be equipped with any kind of linkage system in order to secure the lifting of the rear end of frame 23 when not in use. Said suspension comprises, on the other hand, on the opposite side, a beam 30 swivelling around the swivel 31, which is supported by another fork 32 rigidly connected with the front end of the rear frame 7 in the opposite direction of fork 29. The upper end of beam 30 is articulated with a bracket 33, rigidly connected with the arm 27 of the front frame, whereas its lower end is articulated with a small fork 34 rigidly connected with the frame 23. The beam can be released when the frame 23 is lifted in the upper position, while not in use. Any kind of locking device (not represented) can be foreseen in order to block the beam in position while the frame is in use.

Figure 6:
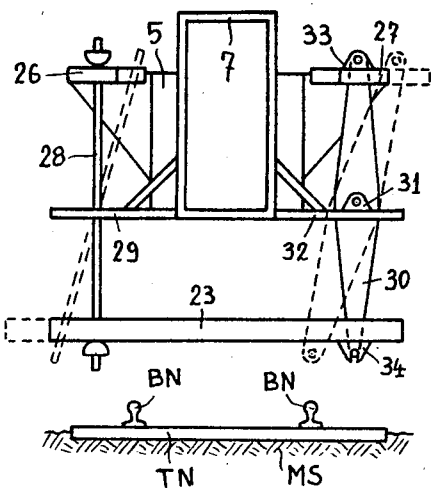
FIGS. 5 and 6 represent respectively a ground plan a and a front view of the rear part of the systm controlling the lateral movement of the frame.

As it can be seen in detail at the FIG. 6, any lateral movement of the arm 27 of the front frame with respect to the fork 32 of the rear frame 7 and which results from the taking of curves, will cause a movement of frame 23 of same importance and in the opposite direction (provided that both arms of the beams 30 have the same length). The FIG. 6 also represents the ballast MS with the new sleepers TN just layed down. One has represented also the new rails BN just to show their respective position on straight sections. In reality, they are not yet layed down at this stage.

Figure 5:
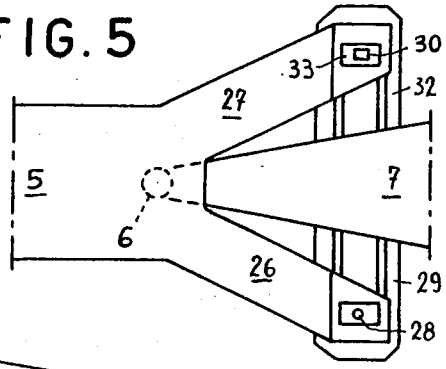
Figure 8:
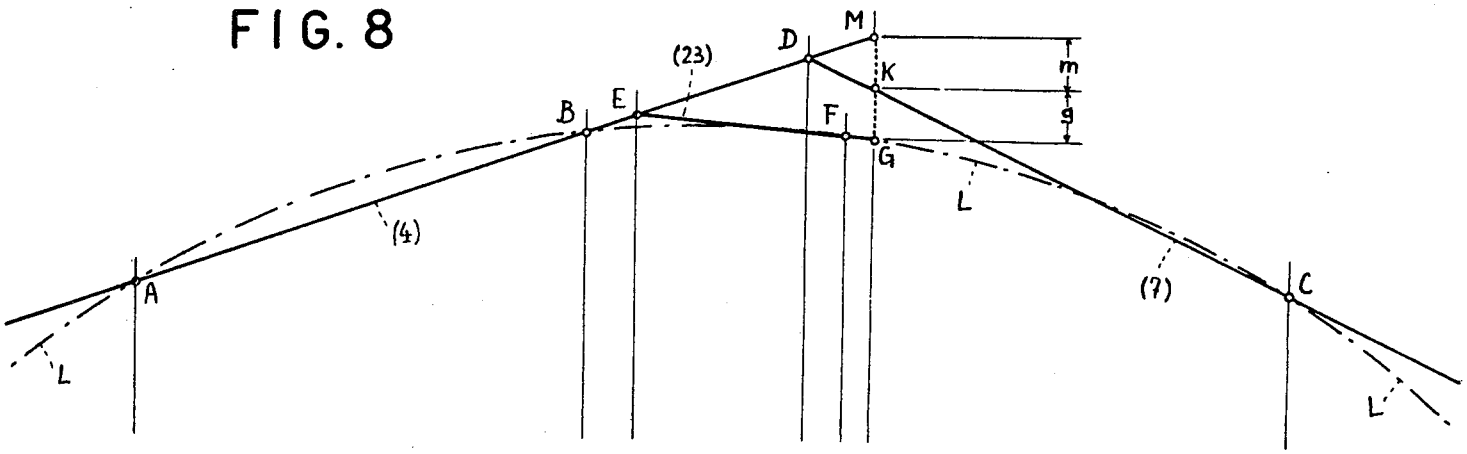
FIG. 8 is a diagram representing the working principles of the structures according to FIG. 7.
Figure 7:
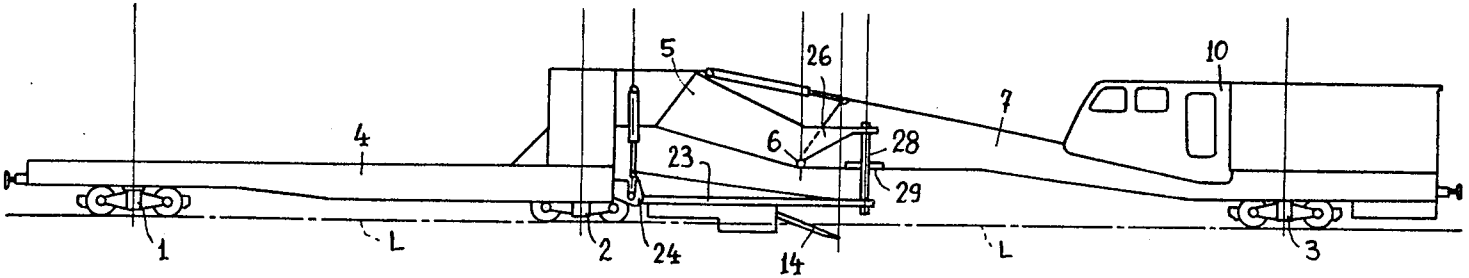
FIG. 7 is a schematic view of the machine.

By referring to FIG. 7 and 8, one will understand how the system specified secures a laying down of the new sleepers TN, realized by machinery 14, made exactly on the trajectory of the track, even in the curves and independently of the radii of the latter. FIG. 7 represents the main parts (according to the present invention) of the machine and their respective projections on the trajectory L of the axis of the railway track represented by a dash-dotted line on FIG. 8. On that trajectory, the point A represents the axis of rotation of the first bogie 1 of the front frame 4. The point B represents the axis of rotation of the middle bogie 2 and the point C, the axis of rotation of the bogie 3 of the rear frame 7. The latter is articulated with the front bogie 1 with the swivel 6 corresponding to the point D on the diagram (FIG. 8). One will notice that this point D will leave the axis of track L when the latter presents a curve. The axis of the front frame 4 is defined by the alignment of point D and points A and B. The position of the hook 24 defines the axis of frame 23 which crosses the straight line ABD at point E (projection of the hook 24). The point F, which represents exactly the center of the laying down area for the new sleepers, the laying being done by the machinery 14 carried by frame 28, must be on the trajectory L of the railway track. As one can see, this requires that point G, which corresponds to the rear end of frame 23, be moved, with respect to point K representing the center of the combination of forks 29 and 32 of the rear frame 7, in the opposite direction from the movement of point M, which itself represents the center of the combination of arms 26 and 27 of the rear frame 4. Referring to the proportions given by the example represented in the annexed drawing, the movement g of point G with respect to point K must be equal to the movement m of point M. This corresponds exactly to the expected correction specified above and applied by the system described by FIGS. 4 to 6.

At FIG. 8, one has purposely exagerated the curvature of the trajectory L in order to emphasize the principle of the invention. One will notice that the proportions represented are independent of the radii of the curves of the track, even for very large radii. Consequently, the correction obtained by the system is always exact whatever the radius of the curve of the line L at the point taken into consideration.

Thanks to the exact correction of the laying down position of new sleepers provided according to the invention, the machine of the present invention can renew tracks of a very short radius, below 20 meters or 60 feet for example. This feature is very important for narrow-gauge tracks, which, up to now, could not be renewed satisfactorily by such machines.

One can choose other proportions for the parts described and the length of both arms of beam 30 must not necessarily be equal, if necessary. Whatever the case, there are no construction difficulties. Furthermore, the cinematic system controlling the movements of the frame 23 in function of the relative movement of both trucks can be realized by other means, different from the one described. The system can be strictly mechanical, or employ for example, hydraulic rams or electromagnetic control means. One can make use of the modifications suggested in the present specification, of other modifications or of any technically equivalent solution, without departing from the scope and range of the present invention.

I claim:

1. A machine for the renewal of railway tracks adapted to effect at least the replacement of old sleepers with new sleepers comprising a front and rear frame connected by a swivel, said front frame resting on a front and middle bogie, with said rear frame resting on a rear bogie, said machine further including a means disposed between said front and middle bogies capable of removing the rails and a means, disposed between said middle and rear bogies, capable of removing old sleepers and replacing new sleepers and in addition, the relaying of the rails, and wherein said middle bogie is provided with a carriage means, said carriage means being defined by a sledge having a width and gauge identical to the width and gauge of the railway tracks, said sledge capable of sliding on said old sleepers, said carriage means enabling said middle bogie to move along said old sleepers in a direction parallel to the longitudinal axis of said railway tracks, said sleepers acting as a lateral guide means for said carriage means, said machine further including a dynamic means disposed close to said swivel and interconnecting said front and rear frames, said dynamic means for imparting forces on both the front and rear bogies thereby reducing the load impinging on said middle bogie by transferring said load to both said front and rear bogies whereby the movement of said middle bogie and said carriage means along said old sleepers is facilitated.

2. A machine according to claim 1 wherein said sledge has runners connected to said middle bogie, said runners having a width and gauge identical to the width and gauge of the railway tracks.

3. A machine as recited in claim 2 wherein said means for relaying the old rails is capable of laying new rails and wherein said runners of said sledge are adapted to remain on the track during the intervals between the renewal working cycles of the machine to insure a continuous interconnection between the ends of the old rails and beginnings of the new rails.

4. A machine as recited in claim 2 wherein said runners of said sledge are formed by cutting a portion of the railway tracks to be renewed, said portion being greater than the length of said middle bogie of said machine, said runners being connected by cross bars.

5. A machine as recited in claim 1 wherein said dynamic means is capable of applying adjustable and controlled forces.

6. A machine according to claim 5 further including a dynamometric control means connected to said middle bogie and said dynamic means, said dynamometric control means for maintaining a constant load value impinging on said middle bogie.

7. A machine as recited in claim 1 wherein said front frame extends rearwardly beyond said middle bogie to define a console and wherein said rear frame is connected to said consold by said swivel, with said dynamic means being connected to said console and said rear frame at a level higher than the level of said swivel.

8. A machine as recited in claim 1 wherein said dynamic means is oriented, during the working cycles, in the direction of the bolster of the rear bogie thereby preventing overstressing of the rear frame.

9. A machine as recited in claim 1 wherein said dynamic means is mounted such that when said frames are tilted due to the banking of curved track sections, resulting in an overload on the internal rail, said dynamic means is operative to apply a counteracting tilting moment in a direction outside the curve to reduce the overload on said internal rail.

10. A machine for the renewal of railway tracks adapted to effect at least the replacement of old sleepers with new sleepers comprising a front and rear frame connected by a swivel, said front frame resting on a front and middle bogie, with said rear frame resting on a rear bogie, said machine further including a means disposed between said front and middle bogies capable of removing the rails and a means, disposed between said middle and rear bogies, capable of removing old sleepers and replacing new sleepers and in addition, the relaying of the rails, and wherein said middle bogie is provided with a carriage means, said carriage means enabling said middle bogie to move along said old sleepers in a direction parallel to the longitudinal axis of said railway tracks, said sleepers acting as a lateral guide means for said carriage means, said machine further including a dynamic means disposed close to said swivel and interconnecting said front and rear frames, said dynamic means for imparting forces on both the front and rear bogies thereby reducing the load impinging on said middle bogie by transferring said load to both said front and rear bogies whereby the movement of said middle bogie and said carriage means along said old sleepers is facilitated, said machine further including an intermediate frame disposed between said front and rear frames and including said means for laying down new sleepers, with the front end of said intermediate frame being pivotally connected to said front frame and with the rear end of said intermediate frame being pivotally connected to both the rear end of said front frame and to the front end of said rear frame such that said intermediate frame is capable of movement in a direction transverse to said front and rear frames whereby when said machinery is riding on a section of curved track and said front and rear frames are displaced out of relative alignment about said swivel, the pivotal connections between said frames, enables said intermediate frame to move transversely relative to said front and rear frames, whereby said new sleepers are laid down at the proper location on the rail bed.

11. A machine as recited in claim 10 wherein said connection between the front end of said intermediate frame and said front frame is disposed in front of said swivel and wherein both the connection between the rear end of said intermediate frame and the rear end of said front frame, and the connection between the rear end of said intermediate frame and the front end of said rear frame, are disposed behind said swivel.

12. A machine as recited in claim 10 wherein said pivotal connections between the rear end of said intermediate frame and said front and rear frames are arranged such that when said machinery is traveling on a section of curved track, causing said front and rear frames to be displaced out of relative alignment about said swivel, resulting in said swivel being displaced a fixed distance outwardly from the curve of the track, said intermediate frame is displaced inwardly towards said curved track in an amount equal to the distance the swivel is displaced outwardly therefrom such that said means for laying said new sleepers is aligned with said rail bed.

* * * * *